US005836384A

United States Patent [19]

Wijkstrom et al.

[11] Patent Number: 5,836,384

[45] Date of Patent: Nov. 17, 1998

[54] HEAT EXCHANGE TANK FOR ASSEMBLY IN A HEAT EXCHANGER AND METHOD OF PRODUCING IT

[75] Inventors: Björn Wijkstrom; Hans Svensson, both of Asarum, Sweden

[73] Assignee: Valeo Engine Cooling Aktiebolag, Solvesborg, Sweden

[21] Appl. No.: 589,955

[22] Filed: Jan. 23, 1996

[30] Foreign Application Priority Data

Jan. 25, 1995 [SE] Sweden ..... 9500249

[51] Int. Cl.[6] ..... F28F 9/02

[52] U.S. Cl. ..... 165/173; 165/177; 165/DIG. 489; 29/890.052

[58] Field of Search ..... 165/173, 153, 165/175, DIG. 489, 176, 177; 29/890.052

[56] References Cited

U.S. PATENT DOCUMENTS

| | | | |
|---|---|---|---|
| 4,938,284 | 7/1990 | Howells | 165/149 |
| 5,193,613 | 3/1993 | Wallis | 165/173 |
| 5,341,872 | 8/1994 | Mercurio | 165/173 |
| 5,450,896 | 9/1995 | Bertua et al. | 165/173 |
| 5,535,819 | 7/1996 | Matsuura | 165/153 X |

FOREIGN PATENT DOCUMENTS

| | | | |
|---|---|---|---|
| 41 30517 A1 | 3/1993 | Germany . | |
| 4335995 | 11/1992 | Japan | 165/173 |
| 5172476 | 7/1993 | Japan | 165/176 |
| 2 098 313 | 11/1982 | United Kingdom . | |

*Primary Examiner*—John Rivell
*Assistant Examiner*—Christopher Atkinson
*Attorney, Agent, or Firm*—Morgan & Finnegan, LLP

[57] ABSTRACT

The invention relates to a heat exchanger tank to be mounted in a heat exchanger, preferably an oil cooler. The tank has an elongate casing (1) with two opposite end openings (11, 11') and a side opening which extends from end opening to end opening. The tank also has two end pieces (6, 6') which sealingly connect to each end opening (11, 11') respectively, and a connecting plate (2) for connection to a heat exchanger assembly included in the heat exchanger. The connecting plate (2) sealingly connects to the boundary edges of the side opening. At each end opening (11, 11') the casing (1) is provided with at least one receiving means (10). Each end piece (6, 6') has at least one recess (14) aligned with the receiving means (10) of the casing (1). A fixing means (17) is inserted through the recess (14) and is fastened in the receiving means (10) of the casing (1). At least one engaging means is arranged at the respective end pieces (6, 6') engaging an end section of the connecting plate (2). The sealing connections are achieved by brazing.

11 Claims, 1 Drawing Sheet

HEAT EXCHANGE TANK FOR ASSEMBLY IN A HEAT EXCHANGER AND METHOD OF PRODUCING IT

FIELD OF THE INVENTION

The present invention relates to a heat exchanger tank for assembly in a heat exchanger, preferably an oil cooler, the tank comprising an elongate casing having two opposite end openings and a side opening extending in the longitudinal direction of the casing from end opening to end opening, two opposite end pieces sealingly connected with a respective end opening, a connecting plate to be connected to a heat exchanger assembly included in the heat exchanger, said plate sealingly connected with the boundary edges of the side opening.

The present invention also relates to a method of producing a heat exchanger tank to be mounted in a heat exchanger, preferably an oil cooler, comprising the steps of assembling an elongate casing of essentially U-shaped cross-section and a connecting plate so as to form a tubular tank section having two end openings, and fixing an end piece at the respective end opening.

The present invention further relates to a heat exchanger comprising at least one heat exchanger tank, a fluid inlet, a fluid outlet and a heat exchanger assembly connected to the heat exchanger tank.

BACKGROUND OF THE INVENTION

Heat exchangers are used in a number of different areas. A very common area of application is the cooling of circulating fluids in a motor vehicle by means of a heat exchanger in the form of a cooler. For example, this can be the cooling of the coolant which cools the engine block in such a vehicle, or the cooling of oil circulating in the engine. In addition, heat exchangers can be used in working machines for cooling hydraulic oil.

One conventional type of cooler design which can be used both as a vehicle cooler for cooling the engine block, and as an oil cooler, comprises partly two cooler tanks, partly a heat exchanger assembly placed between them and connected to the tanks. One tank functions as a collection point for the heated-up cooling fluid or oil, while the other tank collects the cooled cooling fluid or oil and conveys it back to the engine.

The heat exchanger assembly includes a number of radially arranged, flat aluminium tubes with intermediately placed surface enlargers or branches, also of aluminium. Each tank has at least one fluid inlet and one fluid outlet, which are connected to the heat exchanger assembly. Each tank also includes a casing made of plastic, aluminium or similar material, which is produced by deep-drawing, extrusion or bending. The casing also has a connecting plate which forms the bottom of the tank and which has openings for forming said fluid inlet and outlet. Each tank also has at each end a closing assembly in the form of an end piece.

The tubes and branches are connected to each other by brazing, as are the tubes to the connecting plate. When using a plastic casing, it is connected to the connecting plate by means of a bending process. When using an aluminium casing it can, like the tubes, be connected to the connecting plate by brazing. The material thickness of both the connecting plate and the casing is 1–2 mm, while the thickness of the pipes and stems is less, approx. 0.5 mm.

In some applications, more particularly oil coolers in certain types of vehicle, as well as digging machines, great demands are made on the cooler, and more particularly the cooler tank, with regard to withstanding large pressure loadings. In certain types of vehicle the cooler tank is subject to pressures up to 40 bar, which compares with a conventional vehicle cooler in a private car where the tank is subject to a pressure of approx. 1.5 bar. The normally considered way of making the tank resistant to the high pressure is to increase the thickness of the tank walls, which can involve wall thickness of 5–20 mm.

Brazing is carried out by assembling the parts together and fixing them to each other before they are placed in a vacuum oven or an oven with a protective gas atmosphere and fluid. Brazing is then carried out by an outer layer of brazing material being melted onto the respective parts. During brazing, which will be described in more detail later, it is very important that the parts to be connected adjoin each other precisely, for which reason fixtures are often required to hold them together.

Normally the tubes, branches, connecting plate and possibly the casing are connected by brazing, as described above, which takes place in a single step in an oven. It is, of course, also desirable to connect said end pieces to the casing in the same step so as to produce a closed heat exchanger tank.

Brazing of the entire heat exchanger in one piece requires, as stated above, a number of external fixtures, partly for fixing the casing to the connecting plate, partly for fixing the respective end pieces to the respective end sections of the casing and connecting plate.

However, the use of external fixtures leads to a number of serious drawbacks. During brazing, the external fixtures remove heat from the heat exchanger tank itself, which makes brazing considerably more difficult. The problem is particularly evident during the brazing of heat exchangers intended for high pressure applications. The tanks in such heat exchangers are, as has already been stated, produced with large material thicknesses. The amount of material makes it more difficult to achieve an even heat distribution in the components to be brazed together, for which reason brazing is extremely sensitive in this case.

The addition of external fixtures, which steal heat from the tank, can therefore have a negative effect on the brazed joint quality.

In addition, external fixtures can also considerably increase manufacturing costs because it is costly to develop and produce specially-made external fixtures. In addition, the assembly of the tank is relatively complicated, for which reason labour costs are also high. Furthermore, such fixtures result in an undesirable increase in the weight of the heat exchanger during the manufacturing phase.

In order to avoid the above problems of brazing heat exchangers in one piece, the technique is often used of brazing the heat exchanger assembly and connecting plate in one piece. In a separate, manual, operation, the casing and end pieces are welded onto the connecting plate, which is brazed to the heat exchanger assembly.

This method has significant disadvantages. The costs of assembling the heat exchanger, as well as the above fixtures, is high, as brazing is a comparatively complicated and expensive method of connection. In addition, the heat exchanger has to be assembled in more than one stage, as the rest the of the heat exchanger is assembled by brazing. This method is therefore ineffective and time-consuming.

In the light of the solutions described above, it is clear that a better design is required.

One object of the invention is to make available a heat exchanger tank which at least partially mitigates the aforementioned disadvantages, as well as to put forward a method of producing such a heat exchanger tank.

Another object of the invention is to provide a heat exchanger tank which can withstand high pressure loadings and which can at the same time be put together by brazing.

A further object of the invention is to make available a heat exchanger which can withstand high pressure loadings and which can at the same time be put together by brazing.

According to a first aspect of the present invention there is provided a heat exchanger comprising at least one heat exchanger tank, a fluid inlet, a fluid outlet and a heat exchanger assembly connected to the heat exchanger tank, wherein the heat exchanger tank comprises an elongate casing having two opposite end openings and a side opening extending in the longitudinal direction of the casing from end opening to end opening, two opposite end pieces sealingly connected with a respective end opening, a connecting plate to be connected to a heat exchanger assembly included in the heat exchanger, said plate sealingly connected with the boundary edges of the side opening, wherein the casing at each end opening is provided with at least one receiving means, each end piece comprises a recess aligned with the receiving means of the casing, a fixing means is inserted through the recess and fixed in the receiving means of the casing, an engagement means is arranged at the respective end pieces which engages in an end section of the connecting plate, and said sealing connections have been achieved by brazing.

According to a second aspect of the present invention there is provided a heat exchanger tank to be mounted in a heat exchanger, said tank comprising an elongate casing having two opposite end openings and a side opening extending in the longitudinal direction of the casing from end opening to end opening, two opposite end pieces sealingly connected with a respective end opening, a connecting plate to be connected to a heat exchanger assembly included in the heat exchanger, said plate sealingly connected with the boundary edges of the side opening, wherein the casing at each end opening is provided with at least one receiving means, each end piece comprises a recess aligned with the receiving means of the casing, a fixing means is inserted through the recess and fixed in the receiving means of the casing, an engagement means is arranged at the respective end pieces which engages in an end section of the connecting plate, and said sealing connections have been achieved by brazing.

According to a third aspect of the present invention there is provided a method of producing a heat exchanger tank to be mounted in a heat exchanger, comprising the steps of assembling an elongate casing of essentially U-shaped cross-section and a connecting plate so as to form a tubular tank section having two end openings, and fixing an end piece at the respective end opening, wherein the respective end piece is positioned at the casing by inserting at least one fixing means through a recess formed in the end piece and fixing it in a receiving means formed on the casing, the respective end piece is positioned at the connecting plate by an engagement means so as to produce clamping forces holding together the respective end pieces and the connecting plate, the casing, the connecting plate and the end pieces are thereafter connected by brazing.

The object of the invention is also achieved by a method of producing a heat exchanger tank of the above type which has the characteristics set out in the characterising section of claim 9.

The object of the invention is also achieved by means of a heat exchanger of the above type which has the characteristics set out in the characterising section of claim 10.

Features of preferred embodiments are set out in the subordinate claims.

BRIEF DESCRIPTION OF THE DRAWINGS

The invention will be described below in the form of an example with reference to the attached drawings, which illustrate the proposed embodiments and where.

DESCRIPTION OF THE PREFERRED EMBODIMENTS

Figure 1:
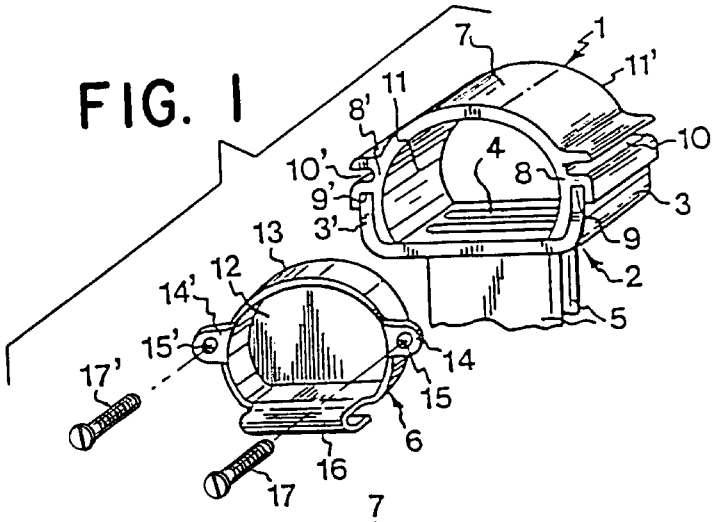
FIG. 1 is a perspective view of a part of an oil cooler tank according to the invention, where certain parts are taken apart.

FIG. 1 shows one embodiment of an oil cooler tank according to the invention. The tank is entirely made of aluminium and has a casing 1 extruded in one piece and a connecting plate 2 which is connected with a heat exchanger assembly (not shown), also of aluminium. The connecting plate 2 has two flanges 3, 3' which extend from the longitudinal edges of the plate 2 approximately at right angles to the plane of the plate 2, and a number of openings 4 for receiving the tubes 5 integrated in the heat exchanger assembly. Together with the tank, the heat exchanger assembly forms one part of a complete oil cooler. At each of its respective ends, the tank also has two end of which only the end piece 6 is shown in FIG. 1, and is provided with at least one connecting stop, which can be arranged both in the casing 1 itself or one of the end pieces. For reasons of clarity, the connecting stop is not shown in the figure.

Over its entire length, the casing 1 has a U-shaped cross-section with a web 7 and two legs 8, 8'. On each leg 8, 8' there is an upside-down channel 9, 9' extending in the longitudinal direction of the casing 1 for receiving the respective flange 3, 3' of the connecting plate. On each leg 8, 8' of the extruded casing 1, there are also two longitudinally extending grooves 10, 10', the function of which will be described below.

The casing 1 delimits two end openings 11, 11' and a side opening. The connecting plate 2 is of a size corresponding to the periphery of the side opening, and is connected to the boundary edges of the side opening by flanges 3, 3' being fitted into said upside-down channels 9, 9' on casing 1.

The end pieces (of which the only end piece 6 is shown) are of a size which corresponds to the periphery of the end openings 11, 11'. The end piece 6 shown in FIG. 1 comprises a plate 12 which is provided with a semi-spherical cavity for taking up the high pressures which subsequently prevail in the tank. Plate 12 has a circumferential flange 13 which is arranged to rest against the inside of the tank at the joined end section of the casing 1 and connecting plate 2. On the outer edge section of flange 13 there are two opposite flaps 14, 14' at right angles to said flange 13. In flap 14, 14' respectively, there is also arranged a recess in the form of a continuous hole 15, 15'. A lower section of the circumferential flange 13 is also provided with an engagement means for engaging one end part of the connecting plate 2. The engagement means in this case consists of a bent outer flange 16, produced in one piece with end piece 6. The outer flange 16 has two legs and web between them. The legs arranged so that, when mounted in the tank, they are essentially parallel to and rest against the end sections of the connecting plate 2.

When mounting the end part 6 on the tank, the circumferential flange 13 is introduced into the end opening 11 to rest against the inner surface of the tank, and the bent outer flange 16 is engaged with the end part of the connecting plate 2 in a form-fitting manner. The holes 15, 15' in flaps 14, 14' respectively are essentially aligned with grooves 10, 10' of the casing 1. To fix the end part 6 to the casing 1, a fixing means 17, 17', for example a self-tapping screw or an aluminium rivet, is inserted through hole 15, 15' respectively and fixed in the respective groove 10, 10', whereby the end part 6 is fixed to the casing 1. When the bent outer flange 16 positively engages one end part of the connecting plate 2, clamping forces are produced which hold the end part 6 and the connecting plate 2 together. Due to this form-fitting engagement, the casing 1 is fixed to the connecting plate 2 via the end part 6 fixed on the casing.

Figure 2:
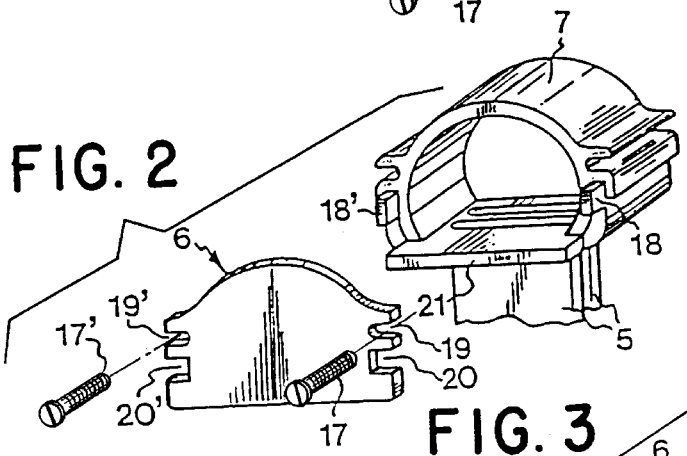
FIG. 2 is a perspective view of part of another oil cooler tank according to the invention, where certain parts are taken apart.

FIG. 2 shows another embodiment of a tank according to the invention. Casing 1 and connecting plate 2 are produced in the same way as in FIG. 1. The corresponding parts are provided with the same reference numbers. Connecting plate 2 differs from the one shown in FIG. 1 in that its respective flanges 3, 3' are provided with a projection 18, 18'. The end parts (of which only the end piece 6 is shown); are of a size essentially corresponding to the periphery of the end openings 11, 11'. The end piece 6 in this case is formed by an end plate provided with recesses 19, 19' for aligning with grooves 10, 10' respectively in casing 1. In addition, two engagement recesses 20, 20' are provided in the end piece for form-fitting engagement, so-called key-fitting, with said corresponding projections 18, 18' on the flanges 3, 3' of the connecting plate 2. In order to further improve contact of end part 6 on the end section of the tank, a bearing heel 21 is provided on the end section of the connecting plate 2.

When mounting the end piece 6 on the tank, the end plate is rested against the bearing heel 21 and the boundary edges of the end opening 11. Recesses 19, 19' in end piece 6 are essentially aligned with respective grooves 10, 10' on casing 1. For fixing the end piece 6 on the casing 1, a fixing means 17, 17', for example a self-tapping screw or an aluminium rivet, is inserted through respective recesses 19, 19' and fixed in respective grooves 10, 10', whereby the end piece 6 is fixed to the casing 1. With the form-fitting engagement of the engagement recesses 20, 20' with the projections 18, 18' on the connecting plate 2, clamping forces are produced which hold the end piece 6 and the connecting plate 2 together. Due to the form-fitting engagement, the casing 1 is fixed to the connecting plate 2 via the end piece 6 fastened on the casing.

Figure 3:
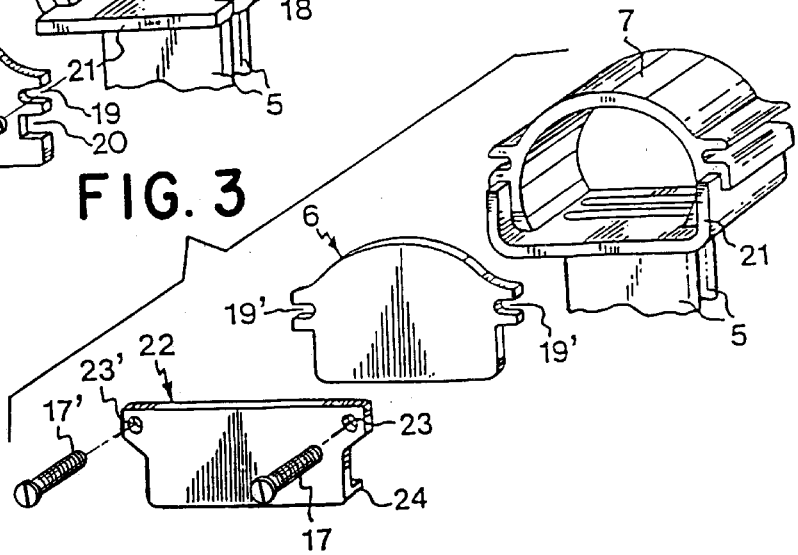
FIG. 3 is a perspective view of part of a further oil cooler tank according to the invention, where certain parts are taken apart.

FIG. 3 shows a third embodiment of the invention, where the end piece 6 is formed of a plate which is of a size which essentially corresponds to the periphery of the end opening 11. The casing and connecting plate are produced as in FIGS. 1–2. The corresponding parts are marked with the same references. The connecting plate 2 differs from the one shown in FIG. 1 in that a bearing heel 21 is provided on its end section. The end piece 6 is, as in FIG. 2, provided with two recesses 19, 19'. The engagement means in this case is formed of a separate fixed plate 22, which is provided with two through holes 23, 23'. At its lower section, the fixed plate 22 has a bend 24, essentially at right angles to the plane of the plate, for resting against the underside of the end section of the connecting plate 2.

When the end piece 6 is mounted on the tank, the end piece 6 is placed in contact with the bearing heel 21 and the boundary edges of the end opening 11. The respective recesses 19, 19' on the end piece 6 are aligned with respective grooves 10, 10' on casing 1. The engagement means is then placed against the end piece 6, the engagement means holes 23, 23' being aligned with respective recesses 19, 19' and grooves 10, 10', and the bend 24 placed against the underside of the end section of the connecting plate 2. For fixing the end piece 6 to the casing 1, a fixing means 17, 17', for example a self-tapping screw or an aluminium rivet, is inserted through respective holes 23, 23' and recesses 19, 19' and fastened in respective grooves 10, 10', the end piece 6 thus being fixed to the casing 1. When the bend 24 engages the connecting piece 2, clamping forces are produced which hold the end piece 6 and the connecting plate 2 together. Due to this engagement, the casing 1 is thus fixed to the connecting plate 2 via end piece 6 fastened on the casing.

The oil cooler is intended to be mounted in two oil cooler tanks, between which a heat exchanger assembly is mounted. In this case, one of the oil cooler tanks has a connection piece forming an oil inlet, while the other has a connection piece forming an oil outlet.

The production of the heat exchanger tank takes place as follows.

The casing 2 is extruded to the above shape and cut to the required length. The end pieces are cut to a shape corresponding to the periphery of the end openings 11, 11', and the connecting plate 2 is bent, extruded or pressed into the above shape. The connecting plate 2 and end pieces are then fixed to the casing 1 at the points described above, whereafter the parts are assembled or joined together with each by means of brazing in a vacuum oven.

Brazing is carried out by at least one of the two parts to be connected to each other having an external aluminium coating with a lower melting point, this coating forming the brazing material when melted which joins the various parts to each other.

The invention can be modified in a number of ways within the context of the scope of protection defined in the following claims. Even though an oil cooler is described in the above for the proposed embodiments, the invention should not be considered limited to oil coolers and heat exchangers in motor vehicles, but can also be used in other areas where heat exchange is required.

The casing can also be formed in a large number of other ways, depending on the design, assembly-friendliness, reception and carrying of other components included in the heat exchanger or surrounding equipment.

It should also be pointed out that the end pieces can be formed in a number of different ways provided that when in contact with the boundary edges of the end openings they close the tank.

The engagement means at the respective end pieces can also he formed in any way. The basic concept is that after assembly, the casing and connecting plate are held together via the end piece, for which reason the use of external fixtures is avoided for this purpose. It is, for example, conceivable that the engagement means consists of one (or more) recesses in the end piece, a fixing means being inserted through the recess and fastened in a groove arranged on the connecting plate, i.e. the engagement happens in the same way as fastening the end pieces to the casing. The engagement assembly can, as already shown in FIGS. 1 and 3, be formed of a part of the end piece or as a separate unit.

The above groove can be formed in any way, as long as the fixing means can be fastened therein. Neither is the number of grooves of decisive importance; one groove is thus enough to be able to fix the end piece to the casing and end section.

We claim:

1. A heat exchanger having at least one heat exchanger tank, where the heat exchanger tank comprises an elongate casing having two opposite end openings and boundary edges defining a side opening extending in the longitudinal direction of the casing from end opening to end opening, two opposite end pieces sealingly connected with a respective end opening, a connecting plate sealingly connected with the boundary edges of the side opening, wherein the casing at each end opening is provided with at least one receiving means for each respective end piece, each end piece has a recess aligned with the receiving means of the casing, a fixing means for each end piece in the recess and fixed in the receiving means of the casing, and a brazed engagement means at the respective end pieces for engagement in an end section of the connecting plate and said sealing connections.

2. A heat exchanger tank comprising an elongate casing having two opposite end openings and boundary edges defining a side opening extending in the longitudinal direction of the casing from end opening to end opening, two opposite end pieces sealingly connected with a respective end opening, a connecting plate sealingly connected with the boundary edges of the side opening, wherein the casing at each end opening is provided with at least one receiving means for a respective end piece, each end piece having a recess aligned with the receiving means of the casing, a fixing means for each end piece in the recess and fixed in the receiving means of the casing, and a brazed engagement means at the respective end pieces which engages in an end section of the connecting plate and said sealing connections.

3. A heat exchanger tank of claim 2, wherein the engagement of said engagement means with the end section of the connecting plate produces clamping forces which act so as to hold the end piece and the connecting plate together.

4. The heat exchanger tank of claim 2, further comprising another end piece recess formed in the end piece and a projection on the end section of the connecting plate to engage the another end piece in a form-fitting manner.

5. The heat exchanger tank of claim 2, wherein the engagement means comprises a bent flange integrally formed with the end piece and engaging the connecting plate in a form-fitting manner.

6. The heat exchanger tank of claim 2, wherein the engagement means comprises a plate which is provided with a flange and has a recess aligned with the receiving means of the casing, said fixing means also extending through the recess of the engagement means and said flange engaging the end section of the connecting plate.

7. The heat exchanger tank of claim 2, wherein the receiving means is an elongate groove in the outer surface of the casing.

8. The heat exchanger tank of claim 2, wherein the fixing means is a self-tapping screw.

9. The heat exchanger tank of claim 2, wherein the fixing means is a rivet.

10. The heat exchanger tank of claim 9 wherein the rivet is of aluminium.

11. A method of producing a heat exchanger tank to be mounted in a heat exchanger, comprising the steps of assembling an elongate casing of essentially U-shaped cross-section and a connecting plate so as to form a tubular tank section having two end openings, and fixing an end piece at the respective end opening, wherein the respective end piece is positioned at the casing by inserting at least one fixing means through a recess formed in the end piece and fixing it in a receiving means formed on the casing, the respective end piece is positioned at the connecting plate by an engagement means so as to produce clamping forces holding together the respective end pieces and the connecting plate, the casing, the connecting plate and the end pieces are thereafter connected by brazing.

* * * * *